US008402568B2

(12) United States Patent
Alstin et al.

(10) Patent No.: US 8,402,568 B2
(45) Date of Patent: Mar. 26, 2013

(54) SYSTEM AND METHOD FOR PROTECTING A BODYPART

(75) Inventors: Terese Alstin, Malmö (SE); Anna Haupt, Malmö (SE)

(73) Assignee: Hövding Sverige AB, Malmö (SE)

( * ) Notice: Subject to any disclaimer, the term of this patent is extended or adjusted under 35 U.S.C. 154(b) by 698 days.

(21) Appl. No.: 12/091,278

(22) PCT Filed: Oct. 26, 2006

(86) PCT No.: PCT/SE2006/001215

§ 371 (c)(1),
(2), (4) Date: Apr. 23, 2008

(87) PCT Pub. No.: WO2007/050024

PCT Pub. Date: May 3, 2007

(65) Prior Publication Data

US 2008/0282453 A1 Nov. 20, 2008

(30) Foreign Application Priority Data

Oct. 26, 2005 (SE) ..... 0502437-7

(51) Int. Cl.
*A41D 13/00* (2006.01)

(52) U.S. Cl. ..... 2/413

(58) Field of Classification Search ..... 2/69, 94, 2/102, 410, 413, 424, 425, 108, DIG. 3, 129, 2/468

See application file for complete search history.

(56) References Cited

U.S. PATENT DOCUMENTS

| | | | | |
|---|---|---|---|---|
| 4,533,335 | A * | 8/1985 | Hoshino | 441/102 |
| 4,637,074 | A | 1/1987 | Taheri | |
| 4,825,469 | A | 5/1989 | Kincheloe | |
| 5,067,921 | A * | 11/1991 | Bramham | 441/102 |
| 5,313,670 | A * | 5/1994 | Archer, III | 2/411 |
| 5,402,535 | A | 4/1995 | Green | |
| 6,125,478 | A * | 10/2000 | Alaloof | 2/456 |
| 7,150,048 | B2 * | 12/2006 | Buckman | 2/465 |
| 7,370,370 | B2 * | 5/2008 | Colombo | 2/69 |
| 2008/0030010 | A1 | 2/2008 | Millet Lopez | |

FOREIGN PATENT DOCUMENTS

| | | | |
|---|---|---|---|
| DE | 27 17 234 | A1 | 11/1978 |
| DE | 2717234 | A1 | 11/1978 |
| DE | 8620408 | U1 | 11/1986 |
| DE | 36 16 890 | A1 | 11/1987 |
| DE | 9314728 | U1 | 1/1994 |
| DE | 4416847 | A1 | 11/1995 |
| DE | 197 54 541 | A1 | 6/1999 |
| DE | 19754541 | A1 | 6/1999 |
| GB | 1 479 733 | A | 7/1977 |
| GB | 2 296 855 | A | 7/1996 |
| GB | 2296855 | A | 7/1996 |

(Continued)

*Primary Examiner* — Tejash Patel
(74) *Attorney, Agent, or Firm* — Capitol City TechLaw

(57) ABSTRACT

A system and a method for protecting the head of a user in case of an abnormal movement, such as a fall or a collision. The system comprises an apparel (1), an airbag (2), an inflator (3), and a trigger. The airbag includes a first part (7) for surrounding the neck and back head portion of the user after inflation, and a second part (8) for forming a hood surrounding the skull of the user after inflation. The first part (7) and second part (8) are folded and arranged in the apparel (1) before inflation. The apparel is arranged around the neck of the user, like for example a collar or a scarf.

12 Claims, 4 Drawing Sheets

FOREIGN PATENT DOCUMENTS

| | | | |
|---|---|---|---|
| JP | 55-124411 | | 9/1980 |
| JP | 59-113324 | | 7/1984 |
| JP | 3-48094 | | 5/1991 |
| JP | 6-72272 | A | 3/1994 |
| JP | 11-129961 | A | 5/1999 |
| JP | 3070441 | U | 8/2000 |
| WO | WO 01/54523 | A1 | 8/2001 |
| WO | 2005013737 | A1 | 2/2005 |

* cited by examiner

SYSTEM AND METHOD FOR PROTECTING A BODYPART

FIELD OF INVENTION

The present invention relates to a system and a method for protecting a body part in case of an abnormal movement, such as a fall or a collision. Specifically, the invention relates to a protective apparel or garment, such as a collar, provided with an airbag system for protecting the head of a bicyclist in case of an accident when biking.

BACKGROUND OF INVENTION

Each year 40 people are killed and at least 20,000 injured in bicycle accidents (in Sweden). It is known that every third bicyclist who is injured in an accident suffers from head injuries. The most efficient protection against severe skull injuries is considered to be the use of a helmet when biking. International studies show that the bicycle helmet decreases the injuries with at least 60%. 40% of the people being killed in bicycle accidents would have survived if a helmet was used.

Despite the alarming statistics on accidents, most people choose to bike without helmet.

The largest use area for bikes in Sweden is not sport activities but every day use. In spite of this, all bike helmets today look sporty. It is obvious that the bike helmet is in the need of a proper facelift.

The helmets of today are molded and mostly produced in EPS (expanded polystyrene) or EPU (expanded polyurethane).

The design of the helmets of today has some drawbacks. They do not protect the jaw, the back of the head, the neck and/or ears in case of a collision with a sharp object. Furthermore, they do not absorb the force of the collision in an optimal manner since both the cover and the body of the helmet is made of an inelastic hard material. Even if the head is not injured, there may be severe brain damages.

In addition, the helmets of today are bulky and unpractical to bring with you when not biking. It is difficult to fasten the helmet on the bike and they are cumbersome to carry along during e.g. shopping.

During the cold period of the year, it is difficult to wear the helmet together with a cap or the like and it is too cold to wear the helmet without the cap, since the material of the helmet is both hard and cold.

Moreover, the bike helmet is considered geeky and unflattering.

A modern airbag system in a car consists of an electronic control unit (ECU) and one or several airbag modules, such as frontal airbags, side-impact airbags, etc. The electronic control unit is usually located in the center of the car. Micro Sensors continuously supervise the acceleration and retardation of the vehicle and transmits the information to a microprocessor, which stores a crash algorithm—or the "crash-impulse". The parameters of the algorithm are adjusted and optimized for each car model. The parameters are determined in crash tests, which are performed in a test center. Many vehicles also have remote sensors located in the doors for controlling the side-impact airbags and remote sensors in the front to discover accidents in good time. When the microprocessor identifies a crash impulse from the sensors, an electric signal is sent to an initiator (a so called squib) in the inflator of the airbag to be inflated. Capacitors in the ECU are used as reserve energy, in case the main battery of the vehicle should be put out of order during the crash. A security function prevents the airbag from being unintentionally released by a mobile telephone or other electromagnetic disturbance.

The airbag module consists of an inflator with an initiator, a textile bag (cushion), a housing and, for the driver airbag, a cover for the steering wheel. The most common type of inflator uses solid fuel, such as pellets, whereas a so-called hybrid generator uses a combination of compromised gas and solid fuel. The textile bag is made of nylon and is folded in a specific way to make it unfold fast and safely. It has vent holes on the back, to assure a soft landing for passengers into the airbag. The housing is generally made of steel, but housings made of strong and lightweight plastics have also been used. It is forced to open by the pressure from the inflated airbag. The cover has a split line, which makes it open at low pressure. The airbag is fully inflated in 20-30 ms.

U.S. Pat. No. 4,825,469 discloses a protective apparel for motorcycle riders and the like comprising an airbag system. In the event of an accident, when the motorcyclist is thrown off the motorcycle, the airbag system is inflated and covers the body of the rider within half a second. The apparel is coupled through an umbilical cord to a container of gas, with a much shorter pull cord being coupled between the rider and the valve of the container to rapidly inflate the apparel on separation of the rider from the motorcycle prior to separation of the umbilical cord. The apparel may be in the form of a jacket which includes a pleated hoodlike portion normally folded and resting under the jacket collar, and a pleated lower portion so that, during inflation, the hood will expand upward and then forward around the top and sides of the head, and the lower portion will inflate and expand downward below the knees.

WO 01/054523 discloses an airbag system, also used in the field of motorcycles, where a rigid neck part comprises inflatable cushions to protect respectively, the neck and back and the chest along with an inflatable balloon for surrounding the head, which balloon is open in front. The airbag system is activated by pulling a contact connected by a wire.

DE19754541 also discloses an airbag system for motorcycles, wherein the airbag system is ring-shaped.

Furthermore, an airbag system used by skiers is known. When a person is buried in the mass of snow from an avalanche a fight against time starts. The rescue process is facilitated by use of an airbag, which skiers and snowboarders carry as a backpack. The airbag is inflated within 3-4 seconds when the skier pulls a string in case of an avalanche. The size of the skier is increased by the airbag and the chances to stay at the top of the avalanche increases. Since the airbag is orange it is also easier to detect the victim in the snow.

The devices of prior art could be made to be effective, protective devices if regularly used. However, because of their general unwieldy appearance, their cumbersome characteristics and inconvenient character in putting them on and taking them off, such protective garments are not currently being used.

Another disadvantage with prior art is that the devices are inflated by pulling a wire or the like. Accordingly, there is a need for a protective apparel which can be made in a stylish and user-friendly form, is as easy to put on and take off as a scarf, is inflated in case of an abnormal movement without having to pull a wire or the like and yet which will provide protection similar or better than prior art helmets. A helmet unlike everything that exists on the market needs to be developed, an ergonomic, handy helmet that meets all necessary safety demands, while being easy to bring along after you have parked your bike.

SUMMARY OF INVENTION

Accordingly, the present invention seeks to mitigate, alleviate or eliminate one or more of the above-identified deficiencies in the art, singly or in any combination and solves at least one of the above-mentioned problems by providing a system and method for protecting a body part in case of an abnormal movement of the user, such as a fall or a collision.

In an aspect of the invention, there is provided a system for protecting a portion of the body of a user in case of an abnormal movement, such as a fall or a collision, wherein said system comprises an apparel and an airbag arranged therein. The airbag comprises a first part suitable for surrounding a neck portion and back head portion of a user after inflation; and a second part suitable for forming a hood surrounding a skull of a user after inflation, said first part and second part being folded and arranged in said apparel before inflation.

In an embodiment, the system may further comprise an inflator for releasing a fluid for inflating said airbag; and control means for controlling said system and said inflator. The control means may comprise a trigger device for controlling the releasing of said airbag, said trigger device comprising at least one sensor. The system may further comprise a fluid deflating means for passing fluid from said inflator to said first part of said airbag. The system may further comprise fluid passing means for passing fluid from said first part of said airbag to said second part of said airbag, when the pressure in the first part of said airbag has reached a predetermined pressure. The air passing means may be a valve or a membrane, the fluid-permeability of which increases at increased pressure over the membrane. The inflator and the control means may be enclosed in a carbon fibre cover.

In another embodiment, the airbag may be provided with several seams on an inner and an outer surface of said second part, and distance webs connecting a seam at the inner surface with a corresponding seam at the outer surface, for limiting the maximum distance between the seams. Moreover, the system may comprise a pocket in said apparel enclosing said airbag in a folded position, said pocket comprising a seam, which is arranged to burst at the inflation of said airbag in order to let out the airbag from the pocket.

In another aspect of the invention, there is provided a method for protecting a head of a user in case of an abnormal movement, such as a fall or a collision, comprising: inflating a first part of an airbag arranged in an apparel arranged around the neck of said user, whereby said first part after inflation surrounds a neck portion and back head portion of said user, inflating a second part (8) of the airbag, whereby said second part after inflation surrounds a skull of said user. The method may further comprise triggering a control means at an abnormal movement, and activating an inflator to inflate a fluid into said first part of said airbag and thence into said second part of said airbag.

In an embodiment, the method comprises inflating said first part in a first step; inflating said second part in a second step when the pressure in said first part has reached a predetermined pressure.

BRIEF DESCRIPTION OF DRAWINGS

Further objects, features and advantages of the invention will appear from the following detailed description of embodiments of the invention with reference to the accompanying drawings, in which.

DETAILED DESCRIPTION OF EMBODIMENTS

Embodiments of a system for protecting a body part in case of an abnormal movement of a user, such as a fall or a collision, will be described below. The embodiment comprises an apparel provided with an airbag system. The apparel may e.g. be a collar, a hip protection, a knee protection, an elbow protection or a vest.

Generally, an airbag of the airbag system is inflated in about 100 ms after activation of sensors recognizing an abnormal motion of a user caused by e.g. an accident. The airbag system may also comprise sensors preventing "false" inflation by accidental activation by cellular phones and other electronic equipments.

The airbag is folded and arranged inside the apparel, which is designed as a collar, that the user is wearing around her/his neck. The airbag is not visible until it is inflated. The inflated airbag has the shape of a hood that surrounds the head during the accident and cushion the shock. The collar may be designed in many different manners and materials, and does not take more space than an ordinary scarf.

Figure 1:
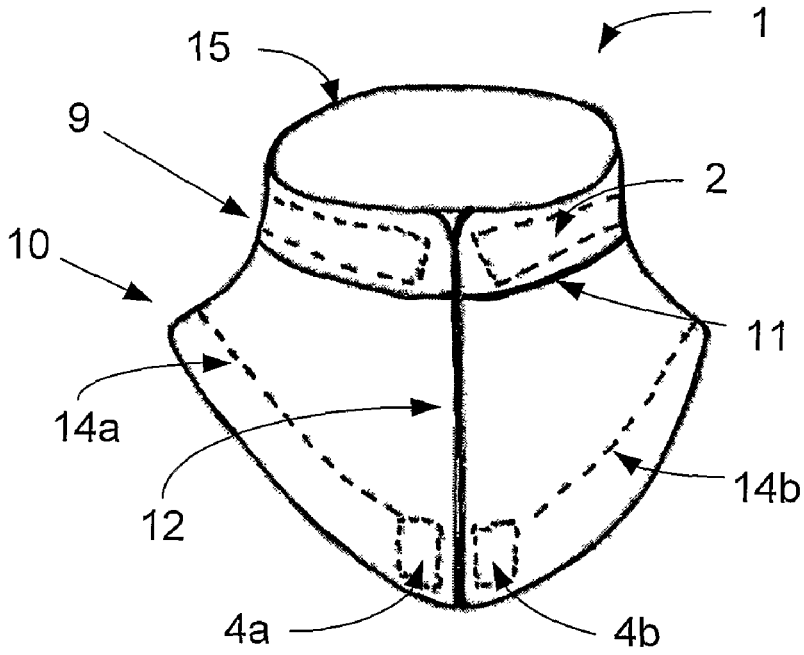
FIG. 1 is a front-view of an embodiment according to the invention.
Figure 2:
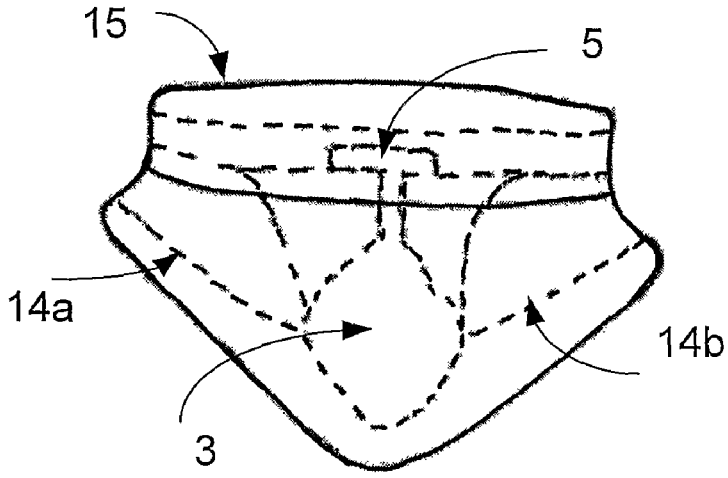
FIG. 2 is a back-view of the embodiment of FIG. 1.
Figure 3:
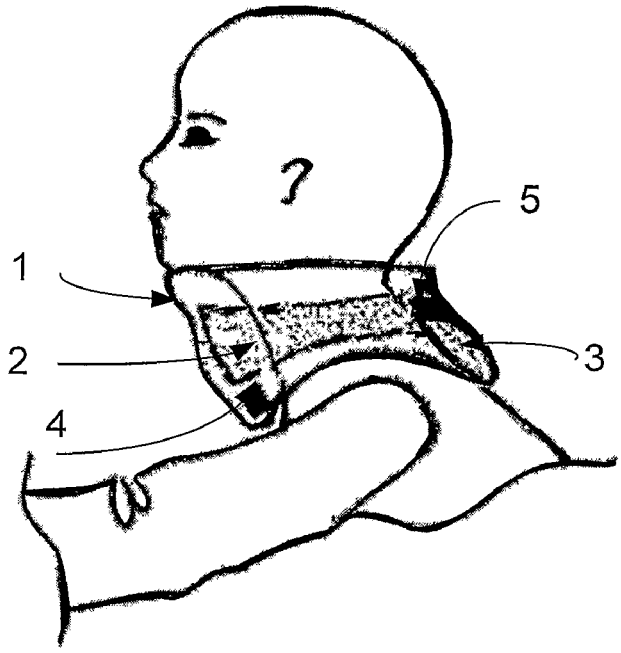
FIG. 3 is a side-view of the embodiment according to FIG. 1 attached to a user and in a non-inflated position.
Figure 4:
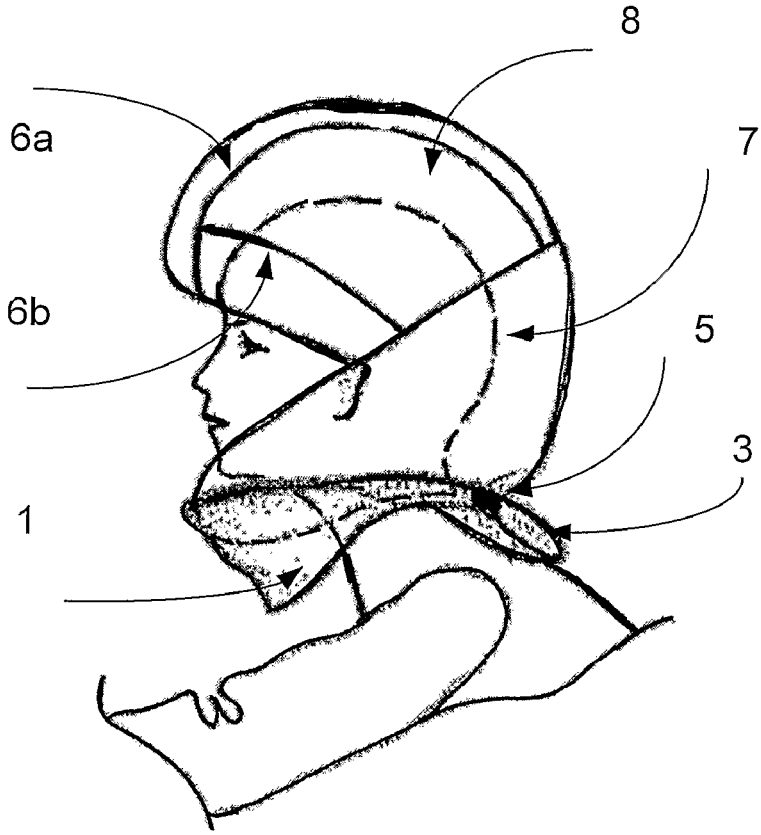
FIG. 4 is a side-view of the embodiment according to FIG. 3 in an inflated position.

FIGS. 1 and 2 illustrate an embodiment where the apparel 1 is designed as a collar provided with an airbag system for protecting the head in case of an abnormal movement, e.g. during cycling. The apparel 1 is placed around the neck of the user and has for that purpose a sealable opening 12, normally at the front of the collar. Alternatively, the opening may be arranged at the back of the collar or at the shoulder portion of the collar. Furthermore, the opening may be totally or partly divideable. The sealing may be a zipper, buttons, a Velcro© fastening, magnets, hooks, hanks, buckles, safety pins, glue, tape, straps or the like.

The collar may be made of any kind of flexible material, such as acetate silk, jeans, fleece, cotton, beaver nylon or the like.

The collar encloses the airbag system, which comprises an airbag, an inflator, and two receptacles. There may be one or several receptacles, depending on the design of the apparel.

The airbag 2 is normally a textile bag, which is folded and packed into an upper portion 9 of the collar, for example in a pocket arranged therein. The airbag 2 extends from the left front side, adjacent the sealed opening 12, around the neck and ends close to the right front side, adjacent the sealed opening 12. The airbag 2 is attached or sewed above a dividing border 11 between the upper portion 9 and a lower portion 10 of the collar and onto the front border up to the opening 12.

The airbag is composed of two parts, a first part 7 covering the neck and back head and a second part 8 covering the upper part of the head, when inflated.

An inflator 3 is located at the back center of the lower portion 10 of the collar and is connected to the airbag 2. The inflator may be a hybrid generator, which is filled with gas. The hybrid generator has no powder, which results in less heat release and a minor bang when the airbag is inflated. The inflator 3 is smaller than most presently available inflators since it is intended for the use of a smaller quantity of gas, approximately 10 liter. The quantity depends on the size of the head.

The volume of the housing or vessel of the inflator 3 may be about 65 $cm^3$ and the walls may have a thickness of material of 1,2 mm, which is slightly more than what is required for a cylindrical inflator. Alternatively, the inflator may be a pyrotechnic airbag inflator, which uses hot gases formed by powder, a cold gas inflator, a hybrid inflator or a heated gas inflator.

The inflator is provided with a deflator 5, for directing the gas into the airbag.

The inflator 3 is screwed, glued, sewed or the like onto the textile bag and the deflator is positioned inside the textile bag 2 for directing the gas into the bag for inflating the airbag in a proper manner. The deflator may be T-shaped for being able to lead the gas into the airbag in a suitable way. Alternatively the deflator may be Y-shaped, I-shaped, arrow-shaped, multiple-part shaped cylindrical shaped or the like.

The inflator is ergonomically shaped to fit comfortably at the back of the user. It may have a rounded shape, optimized for its position and function.

During inflation, the downward recoiling force of the inflator is counteracted by an upward force, which is absorbed by the strong fabric of the textile bag.

The inflator uses a battery, for example with 3 Volt, which may be located in the receptacles 4*a* or 4*b*. The battery may be a rechargeable battery, which is recharged by electrical or kinetic energy or a disposable battery, such as a watch battery.

An indicator, which indicates whether the inner elements of the helmet is intact or not and if the battery is charged or not, is arranged in connection with the electronics. The indicator may be a light emitting diode (LED), which indicates with a light signal if the battery is charged or not or if any of the inner parts are broken. The indicator may also be a sound signal, such as a buzz, a vibrating signal or a smelling signal, which indicates when the battery is almost discharged or if any of the inner parts are broken.

A trigger device, comprising at least one micro sensor and surrounding electronics, controls the inflation of the airbag in case of an abnormal movement and prevents the airbag system from releasing at an undesired occasion. The trigger device may be arranged in the receptacles 4*a*, 4*b* positioned at the front of the collar.

The trigger device is connected to the inflator by use of at least one cable 14*a*, 14*b*.

The components of the airbag system are impact resistant and they are enclosed in water-resistant carbon fiber. All the components are positioned with due consideration to functional and ergonomically aspects. The weight of the different components is uniformly distributed and helps keeping the collar in the right position on the shoulders of the user.

The inflator 3 may be positioned at the back of the collar and the receptacles 4*a*, 4*b* may be positioned in front of the collar on each side of the opening 12 for optimizing the weight distribution of the components and as a counterweight to the inflator. The first portion 9 of the collar encloses the textile bag 2 and the front portion of the second portion 10 of the collar may enclose the receptacles 4*a*, 4*b* and the back portion of the second portion 10 may encloses the inflator 3.

The airbag 2 is designed as a hood, which, in case of an abnormal movement, such as an accident, is brought to surround the neck and the head of the user in order to reduce the impact. The hood is designed and folded in such a way that it is unfolded in a fast and secure manner and that gives an optimized protection to the head.

The airbag is inflated in two steps. In a first step, the first or neck part 7 is inflated and the neck and throat are surrounded and stabilized by the first part 7 of the airbag, to avoid whiplash injuries and head shakings, which may cause severe damages of the user. Then, in a second step, the second or crown part 8 is inflated like a hood covering the crown or scull of the head, the temporal lobe and the forehead to protect these areas.

The neck part 7 may communicate with the back head and crown parts through a valve. The valve is arranged to open when a predetermined pressure in the neck part 7 has been reached, then the crown part 8 starts to inflate. Alternatively, the neck part 7 may communicate with the crown part 8 through a gas-permeable membrane arranged in the wall between the neck part 7 and the crown part 8, where the permeability is arranged to increase at an increased pressure.

The crown part comprises seams 6*a* and 6*b* shown in FIG. 2. Seams 6*a* extend from the neck towards the forehead somewhat to the left and to the right of a symmetry line. Seam 6*b* extends as shown in FIG. 2. There are seams both at the outer surface and the inner surface of the textile bag. Between the inner and outer seams, distance members are arranged in the form of flexible webs or cords, having a length of for example about 7 cm. These members allow the inner and outer surface to be arranged close to or abutting each other when the crown portion is folded, but prevent that the distance between the inner and outer surface exceeds the length of the members. Because of these distance members, the crown portion when inflated forms a hood above the head. In other words, during inflation, the crown portion follows an arcuate path as clearly shown in FIG. 5, sections VIII to XI.

Figures 1, 5:
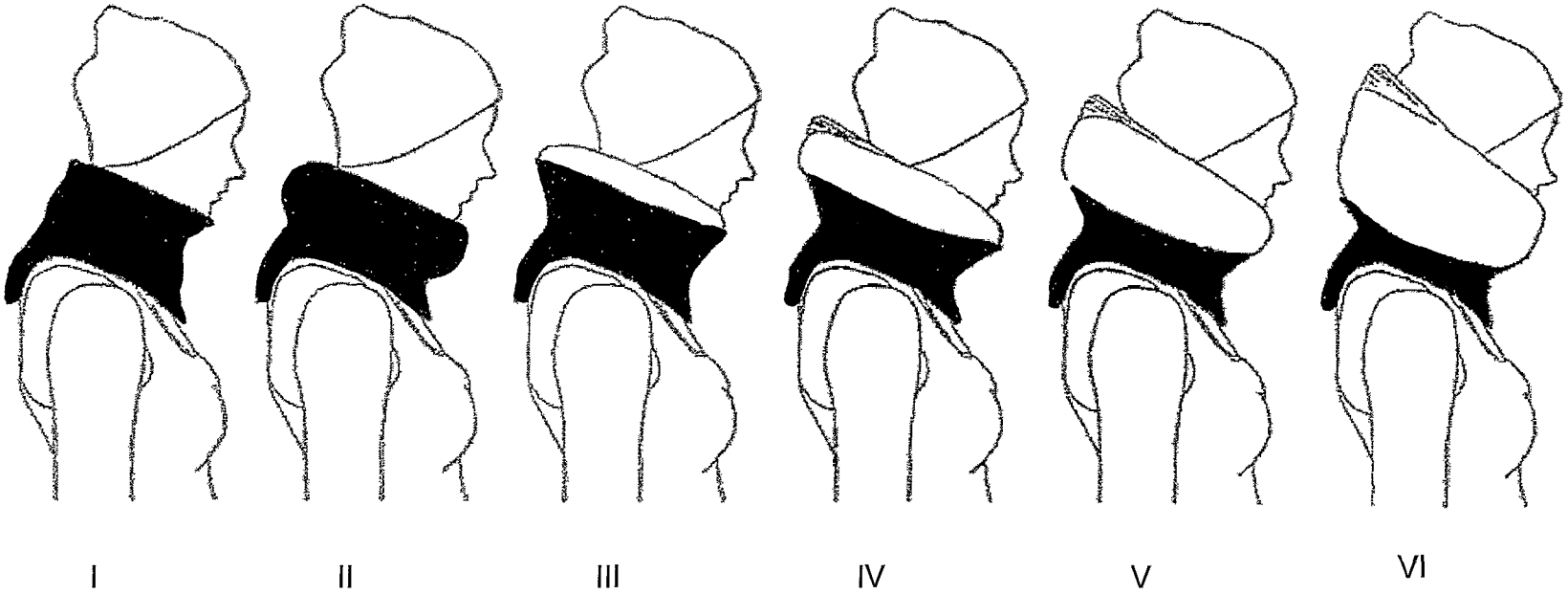
FIG. 5 is a sequence of side views of time instants during inflation of the embodiment of FIGS. 3 and 4.
Figures 2, 5:
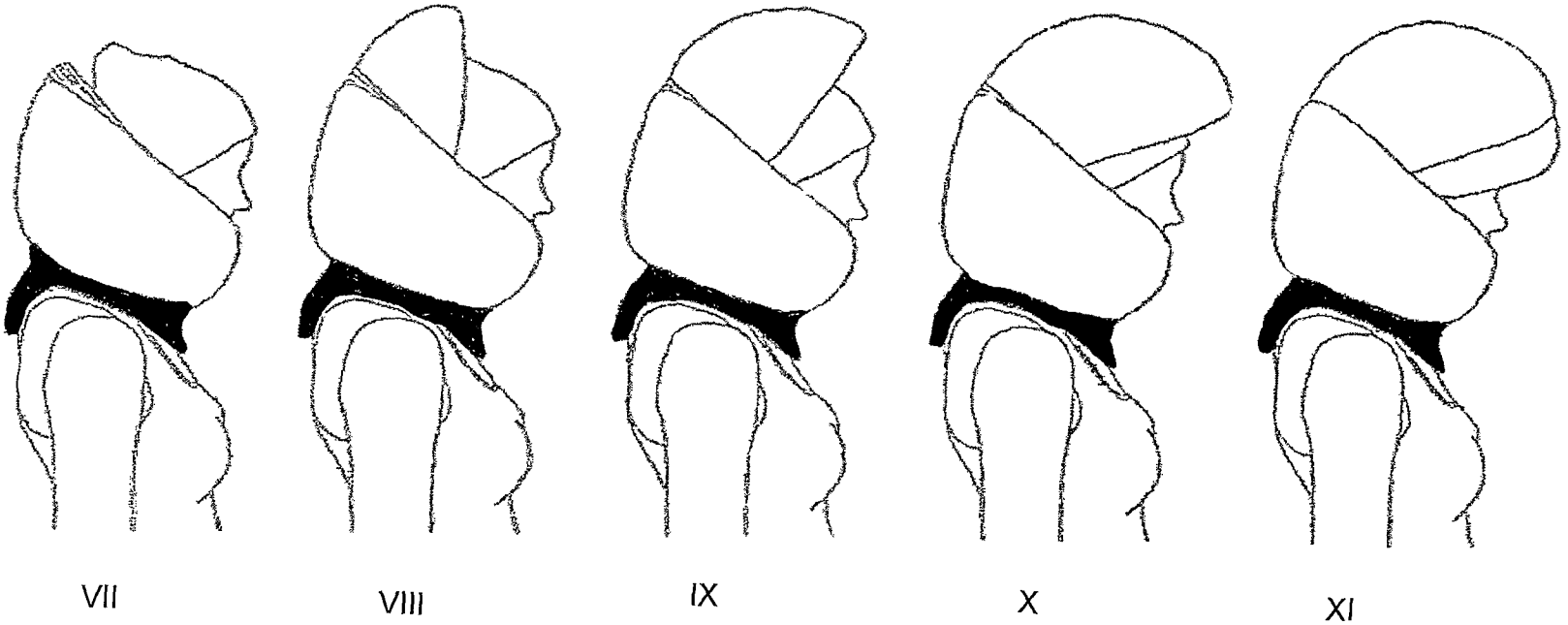

An inflation cycle is shown in more detail in FIG. 5, which comprises eleven sections or time instances during the inflation.

During a first part of inflation, the airbag expands vertically in a substantially cylindrical manner as appears from FIG. 5, section I to VI. During section I, the airbag starts to inflate, and in section II, the airbag is sufficiently inflated to burst a seam 15 enclosing the airbag, see section III. The airbag expands in a cylindrical fashion during sections IV, V and VI. Such expansion is relatively rapid, because of the linear movement. Thus, the neck portion of the head is protected as soon as possible in order to counteract whiplash injuries among others.

When the neck part of the airbag is fully expanded in section V, the air pressure inside the neck part increases and opens the valve between the neck part 7 and the crown part 8. This situation is shown in section VII of FIG. 5.

Then the crown portion starts to inflate. Due to the specific shape of the crown portion and the seams and distance webs therein, the crown portion moves over an arcuate path in order to cover the crown of the head and finally reaches the forehead in section XI. Now, the airbag is fully inflated and protects the user in a proper way.

Since the airbag has to be kept inflated during the fall of the user and at the impact against the ground, the airbag should have a very small vent hole or none at all, in contrast to for example frontal airbags in cars.

The airbag is constructed in a strong and durable nylon fabric for being able to bear a strong impact against for example asphalt and edged objects, but still to be soft and manageable enough to be able to be folded and inflated in an optimal way in case of activation. The inner surface of the airbag may be made of an elastic soft fabric, while the outer surface of the airbag may be made of a more durable material.

The hood may be manufactured of a silicone-coated airbag nylon fabric with silicone-coated thread to get maximum density of the textile bag.

The invention has been designed as a collar used by cyclists. However, the invention is not limited to the embodiments disclosed. The collar may be used in any action-packed sport, such as downhill skiing, riding, or skating. Moped rider may also use the collar, since this field is close to the field of cycling.

Herein above has been described a protective device, such as a collar developed as a helmet for cyclists. However, the invention is not limited to the embodiments disclosed. The different steps can be performed in other combinations than those identified above. Other means normally used within the field of the invention may replace those defined above. The invention is only limited by the appended patent claims.

The invention claimed is:

1. A system for protecting a portion of the body of a user in case of an abnormal movement, said system comprising:

an apparel; and an airbag folded and arranged in said apparel before inflation;

wherein said airbag includes first means for inflating to surround a neck portion and a back head portion of said user; and second means for inflating to form a hood that covers a crown of a skull of said user;

said first means also for beginning inflation prior to said second means.

2. The system according to claim 1, further comprising:

an inflator for releasing a fluid for inflating said first means and said second means of said airbag; and control means for controlling said system and said inflator.

3. The system according to claim 2, wherein said control means comprises a trigger device for controlling the releasing of said airbag, said trigger device comprising at least one sensor.

4. The system according to claim 2, further comprising fluid deflating means for passing fluid from said inflator to said first means of said airbag.

5. The system according to claim 2, further comprising fluid passing means for passing fluid from said first means of said airbag to said second means of said airbag, when the pressure in said first means of said airbag has reached a predetermined pressure.

6. The system according to claim 5, wherein said fluid passing means is one of a valve and a membrane, the fluid-permeability of which increases at increased pressure over said fluid passing means.

7. The system according to claim 2, wherein said inflator and said control means are enclosed in a carbon fibre cover.

8. A system for protecting a portion of the body of a user in case of an abnormal movement, said system comprising:

an apparel and an airbag arranged therein;

wherein said airbag includes a first part suitable for surrounding a neck portion and a back head portion of said user after inflation; and a second part forming a hood during inflation, wherein said hood at least partly surrounds a skull of said user;

said first part and said second part being folded and arranged in said apparel before inflation, and said first part being adapted for inflation prior to inflation of said second part;

a plurality of seams on an inner surface and an outer surface of said second part; and a plurality of distance webs connecting at least one of the plurality of seams on the inner surface with at least one of the plurality of seams on the outer surface, for limiting the maximum distance between the seams.

9. A system for protecting a portion of the body of a user in case of an abnormal movement, said system comprising:

an apparel and an airbag arranged therein;

wherein said airbag includes a first part suitable for surrounding a neck portion and a back head portion of said user after inflation; and a second part forming a hood during inflation, wherein said hood at least partly surrounds a skull of said user;

said first part and said second part being folded and arranged in said apparel before inflation, and said first part being adapted for inflation prior to inflation of said second part;

a pocket in said apparel enclosing said airbag in a folded position, said pocket comprising a seam, which is arranged to burst at the inflation of said airbag to release said airbag from said pocket.

10. A method for protecting a head of a user in case of an abnormal movement, the method comprising:

inflating a first part of an airbag, folded and arranged in an apparel arranged around the neck of said user, wherein said first part after inflation surrounds a neck portion and a back head portion of said user; and inflating a second part of the airbag, folded and arranged in said apparel, wherein said second part during inflation forms a hood that covers a crown of a skull of said users;

wherein said first part begins inflation prior to said second part.

11. The method according to claim 10, further comprising:

triggering control means at an abnormal movement, and activating an inflator to inflate a fluid into said first part of said airbag and thence into said second part of said airbag.

12. The method according to claim 11, comprising:

inflating said first part in a first step; and inflating said second part in a second step when the pressure in said first part has reached a predetermined pressure.

* * * * *